United States Patent [19]

Lotfy

[11] Patent Number: 4,549,736

[45] Date of Patent: Oct. 29, 1985

[54] RACQUET FOR PLAYING A BALL GAME

[76] Inventor: Mohammed H. Lotfy, 28, rue Cherif, Le Caire, Egypt

[21] Appl. No.: 593,533

[22] Filed: Mar. 26, 1984

[30] Foreign Application Priority Data

Sep. 7, 1983 [EP] European Pat. Off. ..... 83401760.0

[51] Int. Cl.[4] ..... A63B 49/08; A63B 59/04

[52] U.S. Cl. ..... 273/67 R; 273/73 J; 273/75; 273/76

[58] Field of Search ..... 273/67 R, 73 J, 75, 273/76

[56] References Cited

U.S. PATENT DOCUMENTS

| | | | |
|---|---|---|---|
| 399,340 | 3/1889 | Morgan | 273/75 |
| 2,280,382 | 4/1942 | Davis | 273/75 |
| 3,934,876 | 1/1976 | Haddad | 273/76 X |
| 4,128,239 | 12/1978 | Grenadier | 273/67 R |

FOREIGN PATENT DOCUMENTS

| | | | |
|---|---|---|---|
| 2514714 | 10/1976 | Fed. Rep. of Germany | 273/76 |

*Primary Examiner*—William H. Grieb

*Attorney, Agent, or Firm*—McAulay, Fields, Fisher, Goldstein & Nissen

[57] ABSTRACT

A racquet for playing a ball game constituted by one piece moulded in rigid plastics material, comprises a frame across which extends a grid formed by rigid bars intersecting one another in two directions, and a handle of constant thickness. The width of the handle decreases progressively from the frame to an intermediate zone of smallest width, then increases to the end of the handle, so as to define two opposite side walls in arcuate form, of outwardly facing concavity. A sleeve made of rubber having the same shape as the handle is fitted and held firmly on said handle.

The rubber sleeve is maintained in place on the plastics handle, without adhesion, by means of hollow parts provided on the handle and/or on the sleeve and in which engage parts in relief provided on the sleeve and/or on the handle.

20 Claims, 5 Drawing Figures

RACQUET FOR PLAYING A BALL GAME

SUMMARY OF THE INVENTION

The present invention relates to a racquet for playing a ball game.

Various types of racquets are already known whose shapes are adapted to the games and sports in which they are used. For example, tennis racquets comprise a fairly elongated oval frame extended by a relatively long handle to enable the player to reach a ball as far as possible, by stretching out his arm. In the case of table tennis, the bats used, which are relatively light, are constituted by a plate of plywood cut out and coated with foam rubber, this plate being extended by a relatively short handle.

Despite the large variety of heretofore known racquets and bats, it has become necessary to design a special racquet for the new ball games which are currently being developed, as not all the existing racquets are adapted to these new games and they prevent the desired performances from being attained. In fact, in the new sport which employs a ball connected by a non-elastic tie to a post resting or fixed on the ground, the individual player must strike the ball as often as possible within a very short, predetermined time. Consequently, the ball being struck with force and returning with force, the handle of the racquet must be short and the hand hold must be fairly close to the centre of the racquet where the ball strikes, otherwise the handle twists in the hand and it is impossible to play quickly. Furthermore, with such a game, as a considerable force is to be developed in a minimum period of time, the hand hold on the handle of the racquet must be as strong as possible. Consequently, not all heretofore known racquets are suitable and it is an object of the present invention to provide a racquet particularly adapted to this game.

SUMMARY OF THE INVENTION

To this end, this racquet for playing a ball game, constituted by one piece moulded in rigid plastics material, comprising a frame across which extends a grid formed by rigid bars intersecting one another in two directions, and a handle of constant thickness, is characterized in that the width of the handle decreases progressively from the frame to an intermediate zone of smallest width, then increases to the end of the handle, so as to define two opposite side walls in arcuate form, of outwardly facing concavity, and a sleeve made of rubber having the same shape as the handle is fitted and held firmly on said handle.

The racquet according to the invention offers the advantage that it enables an excellent hand hold to be obtained and this racquet is prevented from twisting in the hand, even if strikes are intense and repeated. Furthermore, the special incurved form of the handle and sleeve prevents the hand from recoiling and sliding from the handle.

According to a further feature of the invention, the rubber sleeve is maintained in place on the plastics handle, without adhesion, by means of hollow parts provided on the handle and/or on the sleeve and in which engage parts in relief provided on the sleeve and/or on the handle. This glueless asembly of the sleeve on the handle avoids the drawbacks encountered in tennis racquets, namely the possibility of the binding provided on the handle of the racquet slipping or tearing.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
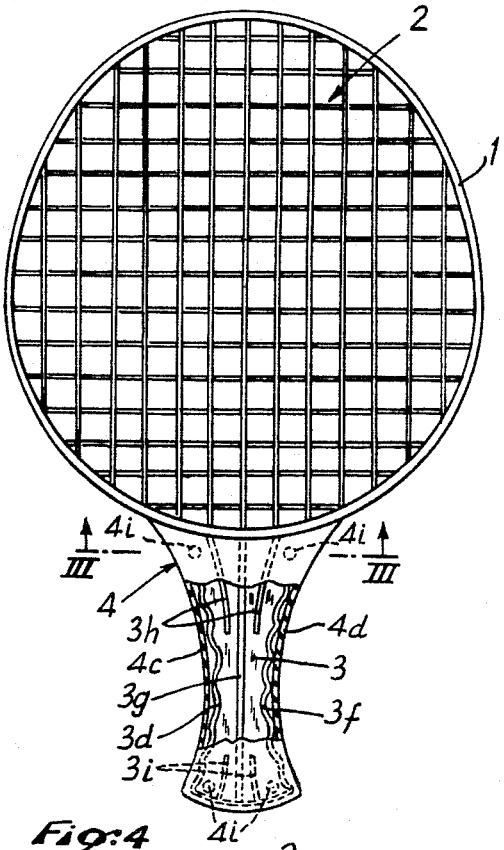
FIG. 1 is a view in elevation of a racquet according to the invention.
Figure 2:
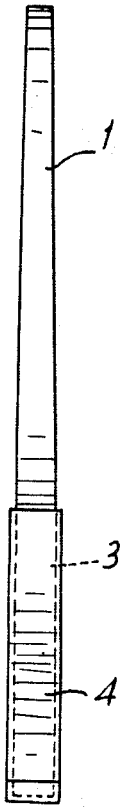
FIG. 2 is a view in section of the racquet of FIG. 1.
Figure 4:
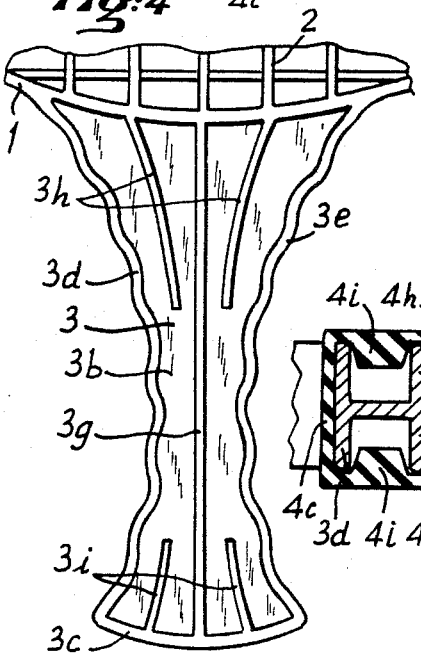
FIG. 4 is a view in elevation, on a larger scale, of the plastics handle bereft of the rubber sleeve.
Figure 3:
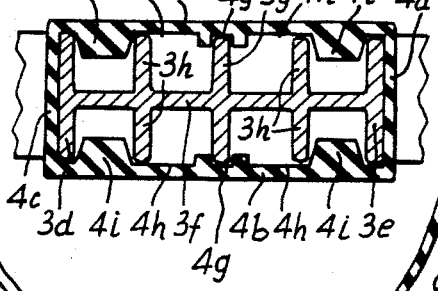
FIG. 3 is a view in transverse section made along line III—III of FIG. 1.
Figure 5:
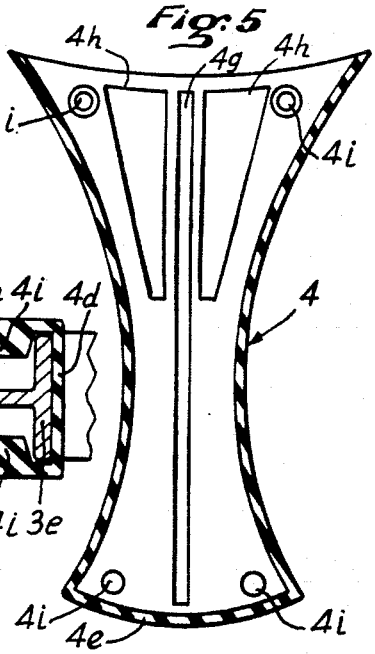
FIG. 5 is a view in longitudinal section of the rubber sleeve separate from the plastics handle.

Referring now to the drawings, the racquet according to the invention which is shown in its entirety in FIGS. 1 and 2, is constituted by one piece moulded in rigid plastics material and comprising an oval frame 1 almost as wide as it is high, i.e. almost in circular form, a grid 2 extending across the frame 1 and constituted by bars of rigid plastics material intersecting one another and extending, parallel to one another in two directions, preferably perpendicular, and a handle 3. This handle 3 is of constant thickness, but its width varies in the longitudinal direction. More particularly, the width of the handle 3 decreases progressively from the end of the handle 3 by which the handle is joined to the frame 1, to reach a minimum in an intermediate zone 3*b* from which the width increases progresively up to the end wall 3*c* of the handle which is preferably arcuate and convex. The width of the end adjacent the frame 1 is greater than that of the opposite end 3*c*. The handle 3 is thus defined by two opposite side walls 3*d*, 3*e* which each present an outwardly facing concavity. Each of these walls 3*d* and 3*e* is preferably corrugated, as is clearly visible in FIG. 4.

The handle 3 may advantageously present a cross section in the form of an I and which is constituted by a central web 3*f* joined to the two opposite side walls 3*d*, 3*e* which are perpendicular to the web 3*f*. The web 3*f* is fast, in its median part, with a longitudinal reinforcing rib 3*g*, perpendicular to the web 3*f* and which extends, symmetrically, on both sides of the web 3*f*, from the frame 1 to the arcuate wall 3*c* constituting the end of the handle 3.

The handle 3 may also comprise other auxiliary reinforcing ribs perpendicular to the web 3*f* and disposed, on each side of this web, between the median longitudinal rib 3*g* and the side walls 3*d*, 3*e*. In the non-limiting embodiment shown in the drawings, the handle 3 comprises, on each side of the web 3*f*, two auxiliary ribs 3*h* starting at the frame 1 and extending, in an arcuate path, in the direction of the intermediate zone 3*b* of the handle, between the median rib 3*g* and the side walls 3*d*, 3*e*. In the same way, two other reinforcing ribs 3*i* extend from the end wall 3*c* over a certain length in the direction of the intermediate zone 3*b* of the handle.

The handle 3 is thus symmetrical, overall, with respect to two perpendicular planes, namely the plane of web 3*f* and the plane of the central rib 3*g*.

To perfect the hand hold of the racquet, the handle 3 made of rigid plastics material is covered by a rubber sleeve 4 which has the same form as the handle 3. In other words, this sleeve 4 which is hollow, is constituted by two upper and lower flat walls 4*a* and 4*b* and two side walls 4*c*, 4*d* perpendicular thereto. The side walls 4*c*, 4*d* of the sleeve 4 present the same arcuate form as the side walls 3*d*, 3*e* of the handle. Said four walls 4*a*, 4*b*, 4*c*, 4*d* are joined to an end wall 4*e* which is arcuate and which presents the same radius of curvature as that of the end wall 3*c* of the handle 3 in order to be able to be applied thereagainst. Opposite the end wall 4*e*, the four walls of the sleeve 4 define an opening enabling this sleeve 4 to be fitted on the handle 3.

Once the sleeve 4 is fitted on the handle 3, thanks to its elasticity, it is maintained firmly in position by projecting parts provided on the handle 3 (or the sleeve 4) engaging in hollow parts provided on the sleeve 4 (or handle 3).

The drawing shows for example that the two upper and lower walls 4*a* and 4*b* of the handle each present, on their inner face, a groove 4*g* extending longitudinally in the median plane of symmetry and in which the end of the central longitudinal rib 3*g* of the handle 3 engages. Furthermore, in the zone close to the open end of the sleeve 4, each of these upper and lower walls 4*a* and 4*b* also presents hollow parts 4*h*, disposed symmetrically on either side of the central longitudinal groove 4*g* and in which are engaged, along the edges of these hollow parts 4*h*, the auxiliary reinforcing ribs 3*h* of the handle 3.

The upper and lower walls 4*a* and 4*b* of the sleeve 4 also present, on their inner faces, bosses 4*i* close to the open end and the end wall 4*e*, these bosses 4*i* engaging in the spaces defined between the arcuate side walls 3*d*, 3*e* and the auxiliary reinforcing ribs 3*h* of the handle 3. Jointly with the grooves 4*g*, these bosses 4*i* contribute to holding the rubber sleeve 4 firmly in place on the rigid plastics handle 3.

What is claimed is:

1. Racquet for playing a ball game, constituted by one piece moulded in rigid plastics material, comprising a frame across which extends a grid formed by rigid bars intersecting one another in two directions, and a handle of constant thickness, wherein the width of the handle decreases progressively from the frame to an intermediate zone of smallest width, then increases to the end of the handle, so as to define two opposite side walls in arcuate form, of outwardly facing concavity, and a sleeve made of rubber having the same shape as the handle is fitted and held firmly on said handle, said rubber sleeve being maintained in place on the plastics handle, without adhesion, by means of hollow parts provided on either the handle or on the sleeve and engage parts in relief provided on the sleeve and/or on the handle.

2. Racquet as claimed in claim 1, wherein said hollow parts are provided on both said handle and said sleeve.

3. Racquet according to claim 1, wherein the width of the end of the handle adjacent the frame is greater than that of the opposite end which is arcuate and convex.

4. Racquet according to claim 1, wherein the two opposite side walls of the handle which each present an outwardly facing concavity, are corrugated.

5. Racquet according to claim 1, wherein the handle comprises a cross section in the form of an I and which is constituted by a central web joined to the two opposite side walls which are perpendicular to the web, the web is fast, in its median part, with a longitudinal reinforcing rib, perpendicular to the web and which extends, symmetrically, on both sides of the web, from the frame to the arcuate wall constituting the end of the handle.

6. Racquet according to claim 5, wherein the handle comprises auxiliary reinforcing ribs which are perpendicular to the web and are disposed, on each side of this web, between the median longitudinal rib and the side walls, certain of these auxiliary ribs extending from the frame in the direction of the intermediate zone, of small width, of the handle, whilst other reinforcing ribs extend from the end wall of the handle towards this intermediate zone.

7. Racquet according to claim 6, wherein the sleeve which is hollow, is constituted by two upper and lower flat walls and two side walls, perpendicular thereto, the side walls of the sleeve present the same arcuate form as the side walls of the handle, said upper, lower and side walls are joined to an end wall which is arcuate and which presents the same radius of curvature as that of the end wall of the handle in order to be able to be applied thereagainst, and opposite the end wall of the sleeve, the upper, lower and side walls of the sleeve define an opening enabling this sleeve to be fitted on the handle.

8. Racquet according to claim 7, wherein the two upper and lower walls of the sleeve each present, on their inner face, a groove extending longitudinally in the median plane of symmetry and which engages the end of the median longitudinal rib of the handle and, in the zone close to the open end of the sleeve, each of these upper and lower walls also presents hollow parts, disposed symmetrically on either side of the median longitudinal groove and in which the auxiliary reinforcing ribs of the handle engage along the edges of these hollow parts.

9. Racquet according to claim 5, wherein the two opposite side walls of the handle which each present an outwardly facing concavity, are corrugated.

10. Racquet for playing a ball game, constituted by one piece moulded in rigid plastics material, comprising a frame across which extends a grid formed by rigid bars intersecting one another in two directions, and a handle of constant thickness, wherein the width of the handle decreases progressively from the frame to an intermediate zone of smallest width, then increases to the end of the handle, so as to define two opposite side walls in arcuate form, of outwardly facing concavity, the width of the end of the handle adjacent the frame being greater than that of the opposite end which is arcuate and convex, and a sleeve made of rubber having the same shape as the handle is fitted and held firmly on said handle, the rubber sleeve being maintained in place on the plastics handle, without adhesion, by means of hollow parts provided on either the handle or on the sleeve and engage parts in relief provided on the sleeve and/or on the handle.

11. Racquet according to claim 10, wherein the two opposite side walls of the handle which each present an outwardly facing concavity, are corrugated.

12. Racquet according to claim 11, wherein the handle comprises a cross section in the form of an I and which is constituted by a central web joined to the two opposite side walls which are perpendicular to the web, the web is fast, in its median part, with a longitudinal reinforcing rib, perpendicular to the web and which extends symmetrically, on both sides of the web, from the frame to the arcuate wall constituting the end of the handle.

13. Racquet according to claim 12, wherein the handle comprises auxiliary reinforcing ribs which are perpendicular to the web and are disposed, on each side of this web, between the median longitudinal rib and the side walls, certain of these auxiliary ribs extending from the frame in the direction of the intermediate zone, of small width, of the handle, whilst other reinforcing ribs extend from the end wall of the handle towards this intermediate zone.

14. Racquet according to claim 13, wherein the sleeve which is hollow is constituted by two upper and lower flat walls and two side walls, perpendicular thereto, the side walls of the sleeve present the same arcuate form as the side walls of the handle, said upper, lower and side walls are joined to an end wall which is arcuate and which presents the same radius of curvature as that of the end wall of the handle in order to be applied thereagainst, and opposite the end wall of the sleeve, the upper, lower and side walls of the sleeve define an opening enabling this sleeve to be fitted on the handle.

15. Racquet according to claim 14, wherein the two upper and lower walls of the sleeve each present, on their inner face, a groove extending longitudinally in the median plane of symmetry and which engages the end of the median longitudinal rib of the handle and, in the zone close to the open end of the sleeve, each of these upper and lower walls also presents hollow parts, disposed symmetrically on either side of the median longitudinal groove and in which the auxiliary reinforcing ribs of the handle engage along the edges of these hollow parts.

16. Racquet as claimed in claim 10, wherein said hollow parts are provided on both said sleeve and said handle.

17. Racquet according to claim 9, wherein the handle comprises a cross section in the form of an I and which is constituted by a central web joined to the two opposite side walls which are perpendicular to the web, the web is fast, in its median part, with a longitudinal reinforcing rib, perpendicular to the web and which extends symmetrically, on both sides of the web, from the frame to the arcuate wall constituting the end of the handle.

18. Racquet according to claim 17, wherein the handle comprises auxialiary reinforcing ribs which are perpendicular to the web and are disposed, on each side of this web, between the median longitudinal rib and the side walls, certain of these auxiliary ribs extending from the frame in the direction of the intermediate zone, of small width, of the handle, whilst other reinforcing ribs extend from the end wall of the handle towards this intermediate zone.

19. Racquet according to claim 18, wherein the sleeve which is hollow is constituted by two upper and lower flat walls and two side walls, perpendicular thereto, the side walls of the sleeve present the same arcuate form as the side walls of the handle, said upper, lower and side walls are joined to an end wall which is arcuate and which presents the same radius of curvature as that of the end wall of the handle in order to be applied thereagainst, and opposite the end wall of the sleeve, the upper, lower and side walls of the sleeve define an opening enabling this sleeve to be fitted on the handle.

20. Racquet according to claim 19, wherein the two upper and lower walls of the sleeve each present, on their inner face, a groove extending longitudinally in the median plane of symmetry and which engages the end of the median longitudinal rib of the handle and, in the zone close to the open end of the sleeve, each of these upper and lower walls also presents hollow parts, disposed symmetrically on either side of the median longitudinal groove and in which the auxiliary reinforcing ribs of the handle engage along the edges of these hollow parts.

* * * * *